United States Patent [19]

Foote

[11] 3,983,724

[45] Oct. 5, 1976

[54] CHANGEABLE COMBINATION PADLOCK

[75] Inventor: Daniel J. Foote, Wauwatosa, Wis.

[73] Assignee: Master Lock Company, Milwaukee, Wis.

[22] Filed: July 21, 1975

[21] Appl. No.: 597,961

[52] U.S. Cl. ..... 70/25; 70/316

[51] Int. Cl.[2] ..... E05B 37/04

[58] Field of Search ..... 70/25, 21, 22, 24, 38 R, 70/38 A, 38 B, 38 C, 315, 316, 317, 318, 321, 322

[56] References Cited

UNITED STATES PATENTS

| | | | |
|---|---|---|---|
| 1,823,650 | 9/1931 | Gordon | 70/25 |
| 1,964,936 | 7/1934 | Denerich | 70/25 |
| 2,853,868 | 9/1958 | Vohlstrom | 70/24 |
| 3,766,758 | 10/1973 | Heine | 70/25 |

*Primary Examiner*—Robert L. Wolfe
*Attorney, Agent, or Firm*—Curtis B. Morsell, Sr.

[57] ABSTRACT

In the present changeable combination padlock the blocking lever which at one end is pivotally associated with the clutch elements for the dialing wheels and at its other end with the shackle locking bolts, is uniquely non-detachably pivotally mounted, intermediate its ends, on an inner, rigidly mounted angular supporting plate; and a pair of coiled springs equally spaced from the side margins of the blocking lever react against the underside of the blocking lever to pull it, with evenly distributed force from its locking bolt-releasing position to its normal position. Additionally, projecting exteriorally of a portion of the padlock case is a turnable changer button which, when turned ninety degrees by an applied tool, coin or finger nail is effective to release certain shaft-carried clutch elements from the permutation wheels for combination changing purposes when the shackle is unlocked and projected to its open position.

6 Claims, 9 Drawing Figures

CHANGEABLE COMBINATION PADLOCK

BACKGROUND OF THE INVENTION AND SUMMARY THEREOF

A general object of the invention is to provide a changeable combination padlock having a novel non-detachable mounting for its pivotal blocking lever with a pair of springs so applied to separated undersurface portions of the supporting plate that the same, by their pulls, exert evenly distributed forces against the blocking lever to bias it in a certain direction for locking bolt releasing purposes.

A further object of the invention is to provide in a changeable combination padlock of the character described, a permanent, exteriorally accessible changer button which, when turned in one direction releases certain clutch elements from the permutation wheels to permit the latter to be turned for combination changing purposes, under certain conditions.

Further objects of the invention are to provide a changeable combination padlock which is relativey simple to manufacture, assemble and operate, in which all of the parts are permanently united, which will resist unauthorized attempts to open it by "rapping," which is strong and durable, which is neat and attractive in appearance, and which is effective for its intended purposes.

DESCRIPTION OF THE PRIOR ART

Applicant is aware of the Vahlstrom U.S. Pat. Nos. 3,419,893 and 2,853,868 as well as the Denerick Pat. No. 1,964,939 but all of these prior patents lack applicant's novel mounting and spring biasing means for the blocking lever. They further lack applicant's permanently mounted, turnable clutch releasing button operable for combination changing purposes.

BRIEF DESCRIPTION OF THE DRAWING

In the accompanying drawing wherein the same reference characters indicate the same parts in all of the views.

DESCRIPTION OF THE PREFERRED EMBODIMENT

Figure 1:
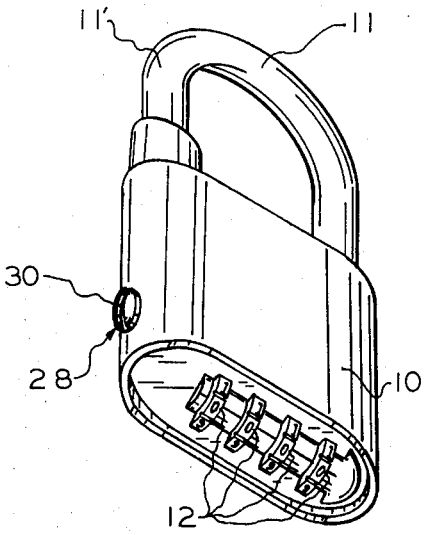
FIG. 1 is a perspective view of a combination padlock incorporating the improved mechanism.

Referring now more particularly to the drawing it will appear that a padlock body or case is indicated by the numeral 10. As is standard, said case has projecting from an end thereof a shackle designated generally by the numeral 11. The shackle, when the padlock is unlocked by proper actuation of the permutation wheels 12, is projected from the closed position of FIGS. 1 and 2 to an open position by a coiled spring 13 confined within the case 10 adjacent a retainer ring 13' mounted toward the inner end of the long leg 11' of the shackle.

Figure 2:
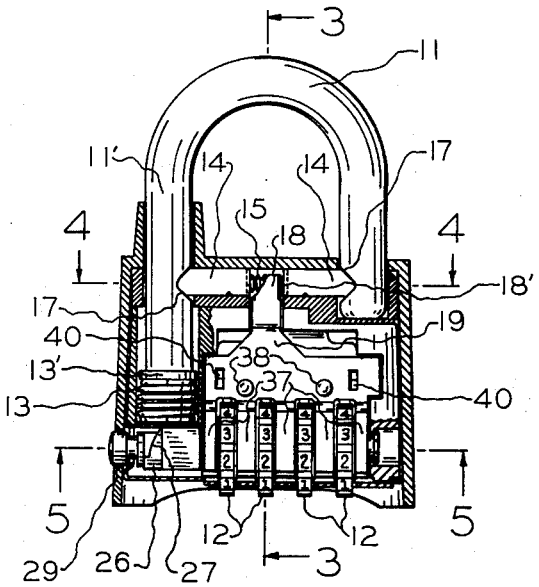
FIG. 2 is a front elevational view of the improved padlock with its case being shown in vertical section.

In order to releasably lock the shackle in its closed position of FIG. 2, a pair of oppositely disposed locking bolts 14 are provided which are operatively housed in an upper portion of the case 10. These bolts 14 are biased in opposite directions by a spring 15, retained on a pin 16, into alined notches 17 having angled walls, and in the legs of the shackle 11.

Figure 3:
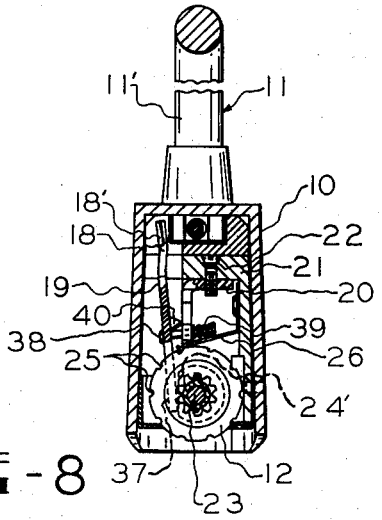
FIG. 3 is a transverse vertical sectional view taken on line 3—3 of FIG. 2 only with the shackle unlocked and projected and the blocking lever rocked to its locking bolt releasing position.

The shackle locking bolts 14 are controlled by the blocking finger portion 18 of a pivotal blocking lever 19 movably housed within an opening therefor in the padlock case 10. Said blocking lever 19 is permanently attached, for pivotal movement, as will hereinafter be described more fully, within the cavity therefor in the case 10 and on one leg of an angular, intermediately disposed plate 20 secured to an internal case element 21 by a single screw or rivet 22, as is best shown in FIG. 3.

Figure 5:
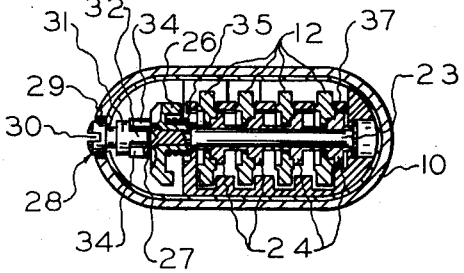
FIG. 5 is a horizontal sectional view taken on line 5—5 of FIG. 2 with the turnable changer button in its normal position wherein the clutch elements are engaging the shaft-mounted permutation wheels.
Figure 8:
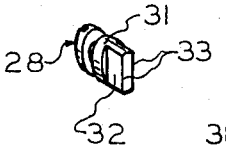
FIG. 8 is a rear and side perspective view of the combination changer button.
Figure 6:
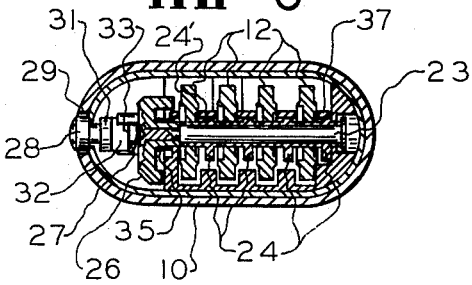
FIG. 6 is a similar horizontal sectional view only showing the changer button turned ninety degrees from the position of FIG. 5 with the resulting disengagement of the clutch discs from the permutation wheels to permit manual turning of the latter for combination changing purposes.
Figure 9:
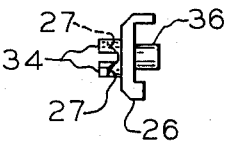
FIG. 9 is a top view of the cam cup which is operatively engaged by the inner end portion of the changer button.

The previously mentioned permutation wheels 12 are carried in spaced relation by a shaft 23 which is longitudinally shiftably mounted in suitable bearings within the lower portion of the case 10. Interposed between the permutation wheels 12 are clutch discs 24 which are rotatably mounted on the shaft and each of which has a flat surface 24' on its periphery. Means for holding the permutation wheels 12 in set position are required and for that purpose each of said wheels has a series of notches 25 on its periphery and a series of band spring members 26, one for each wheel, are mounted on the inner frame portion of the case 10 and are biased into the individual notches 25 as the permutation wheels are turned (see FIG. 3). The left hand end of the shaft 23 (relative to FIGS. 5 and 6) has mounted fast thereon a cam cup 26 whose outermost face is formed with cam surfaces 27. A combination changer button is indicated generally by the numeral 28 and it is mounted for turning movement in an opening 29 therefor in a lower end wall portion of the case 10. The enlarged head of this changer button is externally exposed and is provided with a slot 30 to receive a tool, coin or finger nail by which means the changer button may be turned. An enlarged inner disc portion 31 of the changer button carries an intermediate inwardly projecting plate portion 32 whose edges 33 ride on the cam surfaces 27 of the cam cup 26 when said button is turned. The members are assembled with the plate portion 32 lodged between protubrances 34 on the cam cup which separate the cam surfaces. The inwardly projectng bored sleeve portion 36 receives a reduced end portion of the shaft 23.

As will be brought out more fully hereinafter, when it is desired to change the combination of the lock following unlocking and release of the shackle 11 the changer button 28 should be turned ninety degrees clockwise. This causes the cam button plate edges 33 to ride onto the high portions of cam cup surfaces 27 thereby moving the cam cup 26 from the position of FIG. 5 toward the right, as in FIG. 6, against the tension of a coiled spring 35. The inner end of the shaft-receiving portion 36 of the cam cup will abut the adjacent sleeve portion of the adjacent clutch disc to move it on said shaft and each clutch disc, being in contact with an adjacent clutch disc will cause similar movements of all of the clutch discs (toward the right) disengaging the same from their permutation wheels which cannot move axially along the shaft 23 because they are restrained by the side edges of the slots in the bottom of the case 10 through which the permutation wheels project, and by other means common in the art. Hence, the disengaged permutation wheels are free to be turned to new numbers to establish a new combination.

Figure 7:
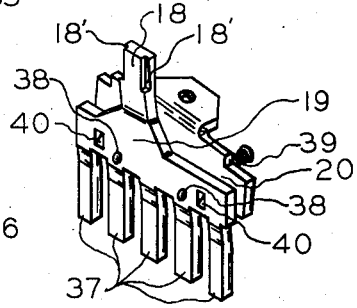
FIG. 7 is a front and side perspective view of the blocking lever mounted on its supporting plate.

The previously referred to blocking lever 19 is shown in detail in FIG. 7. Projecting downwardly from its main intermediate portion are a series of spaced-apart clutch disc engaging fingers 37. At the opposite end of the blocking lever 19 is the previousy referred to blocking finger 18 which has shouldered recesses 18′ in its side edge portions for the disengagable reception of the inner ends of the locking bolts 14 (see FIG. 2 wherein one side portion of the blocking finger is shown broken away). The blocking lever 19, as was previously mentioned, is pivotally mounted on the downturned flange of the plate 20 by a pair of studs 38 each of which carries a biasing spring 39. These springs 39 are equally spaced from the side margins of the intermediate plate portion of the blocking lever 19 and react against the underside of the flanges of the plate 20, causing the blocking lever to be pulled with evenly distributed force, from its normal position of FIG. 2 to its locking bolt releasing position of FIG. 3. In its movements said blocking lever rocks on a pair of spaced-apart cone-line protuberances 40 swaged out of the metal of the blocking lever and contactable with separated inner face portions of the downturned flange of the plate 20.

The operation of the improved changeable combination padlock is such that when the shackle 11 is retracted and locked, the clutch disc engaging fingers 37 are on the high sides of the clutch discs 24 with the clutch discs engaging the permutation wheels. The blocking lever 19 is thereby rocked against the force of the springs 39 so that the blocking finger 18 is in a position to have its notches 18′ engaged by the inner ends of the locking bolts 14 to hold the same in position so that their tapered outer ends are in the notches 17 of the legs of the shackle 11 to hold the same in its inner locked position, as in FIG. 2. Any attempt to force the shackle outwardly will tend to cam said locking bolts more tightly into the shackle leg notches and against the blocking finger 18.

To unlock the shackle 11 and have it projected to its open position the clutch discs 24 are properly positioned by manually turning their respective permutation wheels 12 to the assigned combination. The long shackle is then depressed to permit the locking bolts 14 to move apart under the influence of the spring 15 and out of interlocking engagement with the blocking finger recess 18′ whereupon, under the influence of the springs 39, it will be swung outwardly to the position shown in FIG. 3 away from the locking bolts to allow the latter to move inwardly thereby releasing the shackle. The flat sides 24′ of the clutch discs are all aimed so that the blocking plate fingers 37 can drop thereonto. The spring 13 will project the shackle outwardly to its open position.

Figure 4:
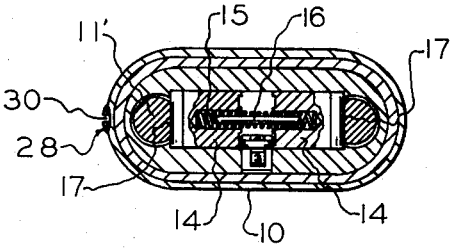
FIG. 4 is a horizontal sectional view taken on line 4—4 of FIG. 2.

When the shackle is to be closed several of the permutation wheels are first turned away from their combination numbers. This brings the high portions of the clutch discs under the corresponding blocking lever fingers 37 to move the blocking lever in a clock-wise direction relative to FIG. 3. When the shackle is ultimately pushed in the locking bolts will move into the shackle notches 17 allowing the blocking finger 18 to engage the locking bolts to hold the same in shackle locking position, as in FIGS. 2 and 4.

If it is desired to change the lock combination the lock shackle is first unlocked and projected to its open position in the manner previously described. Next, by means of a tool, coin or the like inserted into the slot 30 of the changer button 28 the latter is turned 90° in a clock-wise direction. Said turning movement of the button 28 causes, through the riding of the button plate edges 33 onto the high portions of the cam cup surfaces 27, disengagement of the clutch discs from the permutation wheels all as previously explained, whereby the permutation wheels are free to be manually turned to establish a new combination. After the new combination is established, the changer button 28 should be turned in a reverse direction to its original position. The clutch shaft 23, under the influence of its spring 35, returns to its position in FIG. 5 wherein the clutch discs engage their respective permutation wheels 12. One or more of the permutation wheels may be turned off of the combination to upset the latter so that an unauthorized person cannot see the true combination. Subsequently when the shackle is pushed inwardly to its locked position everything is in order to operate the lock under the new combination. The latter cannot be changed unless the specific steps previously mentioned are taken which includes the turning of the button 28 when the shackle is in its released, projected position.

From the above description it will be evident that the improved changeable combination padlock is generally well adapted for the intended purpose.

What is claimed is:

1. In a permutation lock, a body, a shackle movable therein and having a closed position and a projected open position, means for releasably locking said shackle in its closed position including a blocking lever, means for pivotally mounting said blocking lever within said body including studs spacedly carried by said blocking lever and a plate fixedly mounted within said body through which the blocking lever-carried studs movably project, a shaft movably mounted within said body, a plurality of permutation wheels carried by said shaft, clutch discs mounted on said shaft and movable therewith, there being a clutch disc for each permutation wheel, and a turnable member alined with said shaft and having an inner portion operatively associated with said shaft, the outer end portion of said turnable member being accessible exteriorally of the lock body whereby turning movements of the turnable member will move said shaft and the clutch discs.

2. The permutation lock recited in claim 1 wherein the means for pivotally mounting the blocking lever within said body are non-disengageable.

3. The permutation padlock defined in claim 1 wherein said studs carry springs which react against portions of said fixed plate and function to bias the blocking lever under certain conditions.

4. The permutation padlock defined in claim 3 wherein said stud springs are equally spaced from opposite side margins of the blocking lever to exert uniform biasing forces on the latter.

5. The permutation padlock defined in claim 3 wherein said springs reacting on their studs, exert pulling forces against the under surface of the blocking lever.

6. Th permutation padlock defined in claim 1 wherein said shaft is axially shiftable upon turning movement of the turnable member in one direction, the shaft, when so shifted carrying the clutch discs therewith to disengage the same from their permutation wheels which do not move with the shaft.

* * * * *